US008881963B2

(12) United States Patent
Cortez

(10) Patent No.: US 8,881,963 B2
(45) Date of Patent: Nov. 11, 2014

(54) ENHANCED PNEUMATIC TOOL ACTUATION DEVICE

(75) Inventor: Genaro O. Cortez, Bolingbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 231 days.

(21) Appl. No.: 12/265,944

(22) Filed: Nov. 6, 2008

(65) Prior Publication Data

US 2009/0072005 A1 Mar. 19, 2009

Related U.S. Application Data

(63) Continuation-in-part of application No. 11/848,667, filed on Aug. 31, 2007, now Pat. No. 7,690,546.

(51) Int. Cl.
*B25C 1/04* (2006.01)

(52) U.S. Cl.
CPC ..... *B25C 1/047* (2013.01)
USPC ..... 227/130; 227/129; 227/8

(58) Field of Classification Search
CPC ..... B25C 1/04; B25C 5/10; B27C 3/08; F41C 27/00
USPC ..... 227/8, 129, 130; 89/27.3; 42/89.01; 251/324; 173/2, 168, 169
See application file for complete search history.

(56) References Cited

U.S. PATENT DOCUMENTS 3,272,267 A 9/1966 Langas
3,563,438 A * 2/1971 Doyle et al. ..... 227/8
3,653,299 A 4/1972 Howard
3,796,270 A 3/1974 Lange
3,815,475 A * 6/1974 Howard et al. ..... 91/399
3,815,627 A 6/1974 Farrell et al.
3,828,458 A * 8/1974 Skone-Palmer ..... 42/69.01
4,122,904 A 10/1978 Haytayan
4,194,664 A * 3/1980 Siegmann ..... 227/8
4,196,833 A * 4/1980 Haytayan ..... 227/8

(Continued)

FOREIGN PATENT DOCUMENTS

CN 1391507 A 1/2003
JP 2004351523 A 12/2004

OTHER PUBLICATIONS

International Search Report and Written Opinion of the International Searching Authority issued Nov. 20, 2009, in connection with PCT/US09/059183.

(Continued)

*Primary Examiner* — Gloria R Weeks
(74) *Attorney, Agent, or Firm* — Levenfeld Pearlstein, LLC

(57) ABSTRACT

The present invention is directed to a pneumatic tool actuation device comprising a housing configured to be attached to a pneumatic tool, a piston slidably moveable within a drive chamber formed within the housing and an air inlet chamber formed within housing and configured to accept a pressurized gas and direct it to the drive chamber. The piston further comprises an O-ring disposed in an annular groove formed in the piston and forming a seal between the piston and the drive chamber. The housing is removably attached to an opening near a trigger valve pin. The air inlet chamber is operably connected to a hose through which a pressurized gas travels and enters the housing to move the piston. The movement of the piston directly actuates the trigger valve pin located in the pneumatic tool.

17 Claims, 13 Drawing Sheets

(56) References Cited

U.S. PATENT DOCUMENTS

| | | | | |
|---|---|---|---|---|
| 4,284,223 | A * | 8/1981 | Salcido et al. | 227/5 |
| 4,385,297 | A * | 5/1983 | Schmitt et al. | 340/870.31 |
| 4,448,338 | A * | 5/1984 | Graf et al. | 227/8 |
| 4,509,669 | A | 4/1985 | Elliesen | |
| 4,697,992 | A | 10/1987 | Hatakeyama | |
| 4,869,008 | A * | 9/1989 | Rasmussen | 42/71.01 |
| 4,932,313 | A * | 6/1990 | Gutknecht | 92/181 R |
| 5,410,942 | A * | 5/1995 | Begneu | 89/27.14 |
| 5,463,918 | A * | 11/1995 | Lemieux et al. | 81/487 |
| 5,593,079 | A * | 1/1997 | Mukoyama et al. | 227/8 |
| 6,079,605 | A * | 6/2000 | Braun et al. | 227/130 |
| 6,712,256 | B1 * | 3/2004 | Curry | 227/111 |
| 6,722,547 | B1 | 4/2004 | Wang et al. | |
| 6,837,415 | B1 | 1/2005 | Huang | |
| 7,124,837 | B2 | 10/2006 | Martin et al. | |
| 7,228,917 | B2 | 6/2007 | Davis et al. | |
| 7,690,546 | B2 * | 4/2010 | Cortez | 227/130 |
| 2007/0074882 | A1 | 4/2007 | Davis et al. | |
| 2008/0190988 | A1 * | 8/2008 | Pedicini et al. | 227/130 |

OTHER PUBLICATIONS

"DUO-FAST, Nailers Staplers Fasteners, Safety, Operation & Instruction Manual, Pneumatic Fastening Systems" 2000, DUO-FAST Corporation Form No. Manual Pneumatic, Nov. 2000.

* cited by examiner

ENHANCED PNEUMATIC TOOL ACTUATION DEVICE

CROSS-REFERENCE TO RELATED APPLICATION DATA

This application is a continuation-in-part (CIP) of application Ser. No. 11/848,667 filed on Aug. 31, 2007, entitled Pneumatic Tool Actuation Device.

BACKGROUND OF THE INVENTION

The present invention relates to pneumatic tools. Specifically, the present invention is directed to a pneumatic tool actuation device.

Pneumatic tools are becoming increasingly common in many industries, including the construction industry. Examples of pneumatic tools include pneumatic nailers, jackhammers, riveters, staplers, and the like. The operation of most pneumatically-operated tools is relatively simple: compressed air flows through a tube into the housing of the pneumatic tool and the pressure of the compressed air is used to force movement of a piston or other mechanism in the tool to do work.

A pneumatic tool typically is activated by depressing a trigger to drive the nails, rivets, staples, or similar fasteners from the tool. In automated applications, actuation devices are used to depress the trigger of the pneumatic tool. These actuation devices, though, can be large and involve complicated assembly. For example, known actuation devices use elaborate pulley systems; these devices, however, can be heavy and sometimes interfere with the use of the tool. In cases where the tool is relatively small, no comparably small automatic actuation devices are available.

Accordingly, there is a need for a simple, easy to use, lightweight pneumatic tool actuation device. Desirably, such an actuator is made of a lightweight material and is able to withstand fast, repetitive use. More desirably, such an actuator is readily made and usable, and has a high degree of integrity at minimal cost.

BRIEF SUMMARY OF THE INVENTION

The present invention is directed to a pneumatic tool actuation device. The device comprises a housing configured to attach to a pneumatic tool, a piston slidably moveable within a drive chamber formed within the housing, and an O-ring disposed in a groove formed in the piston and forming a seal between the piston and the drive chamber. The housing has a gas inlet/outlet which is configured to be connected to a hose through which a gas travels and enters the drive chamber to slidably move the piston within the drive chamber. The movement of the piston directly actuates a trigger valve pin on the pneumatic tool.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
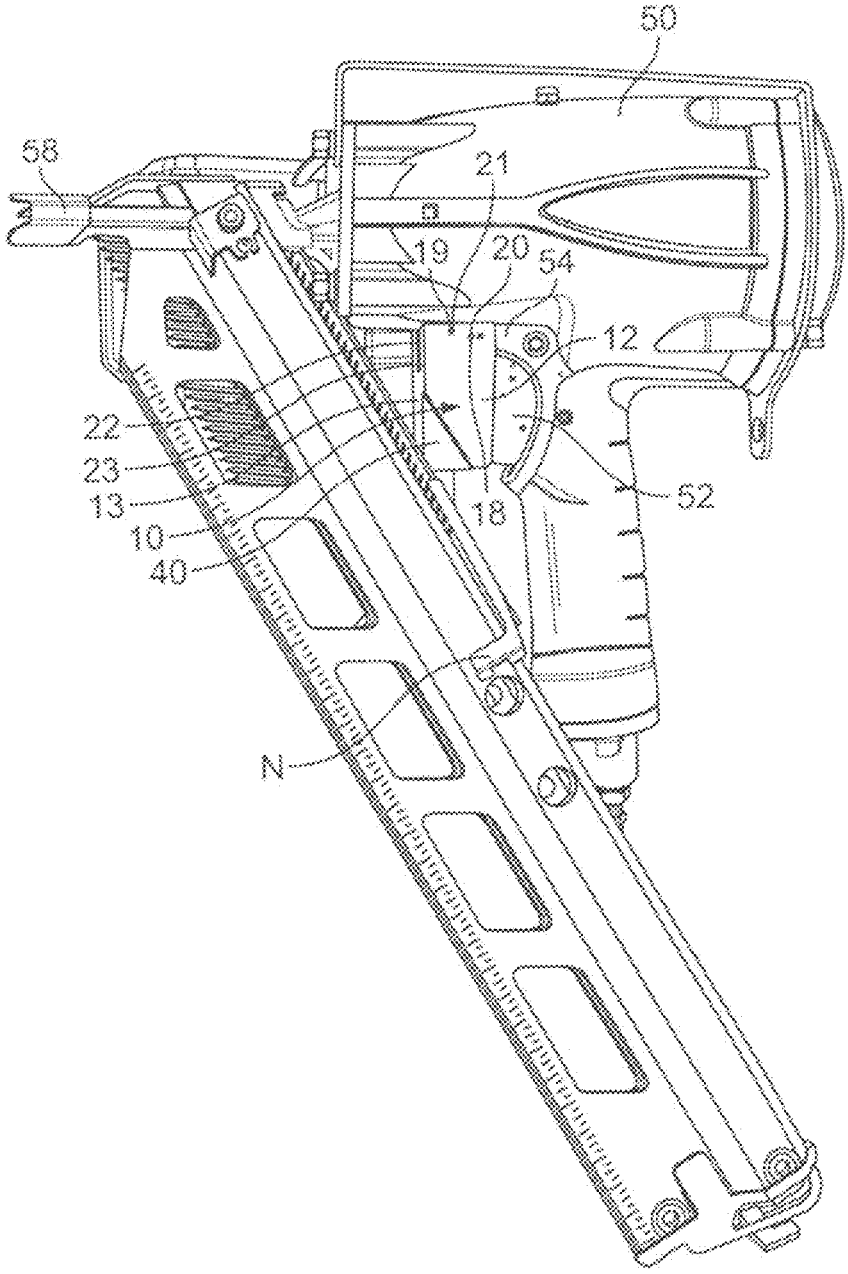
FIG. 1 is a left side view of the pneumatic tool actuation device in the preferred embodiment of the present invention shown attached to a pneumatic tool.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention," relates to a requirement of the United States Patent Office, and does not imply, nor should be inferred to limit the subject matter disclosed herein.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

The present invention pertains to an actuation device or actuator configured to depress a trigger on a pneumatically driven tool as illustrated in the figures. The actuator can be used on a pneumatic nailer as shown; however, it is also contemplated that the actuator can be used on other pneumatic tools and such uses should be considered to be within the scope of this invention. The actuator is configured to depress a trigger on the pneumatic tool when the actuator is actuated, thereby actuating the pneumatic tool.

Figure 3:
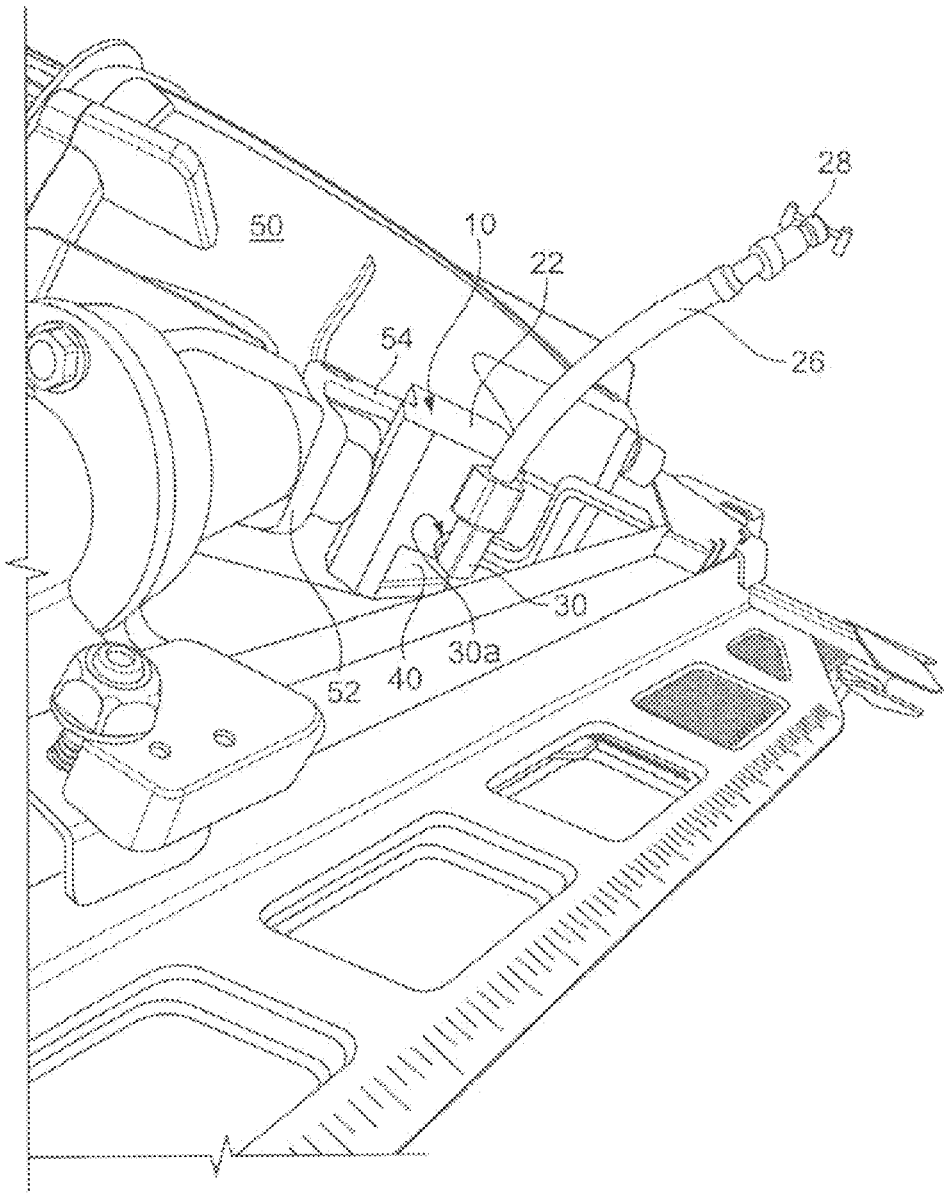
FIG. 3 is a bottom perspective view of the actuation device of the present invention attached to a pneumatic tool.
Figure 4:
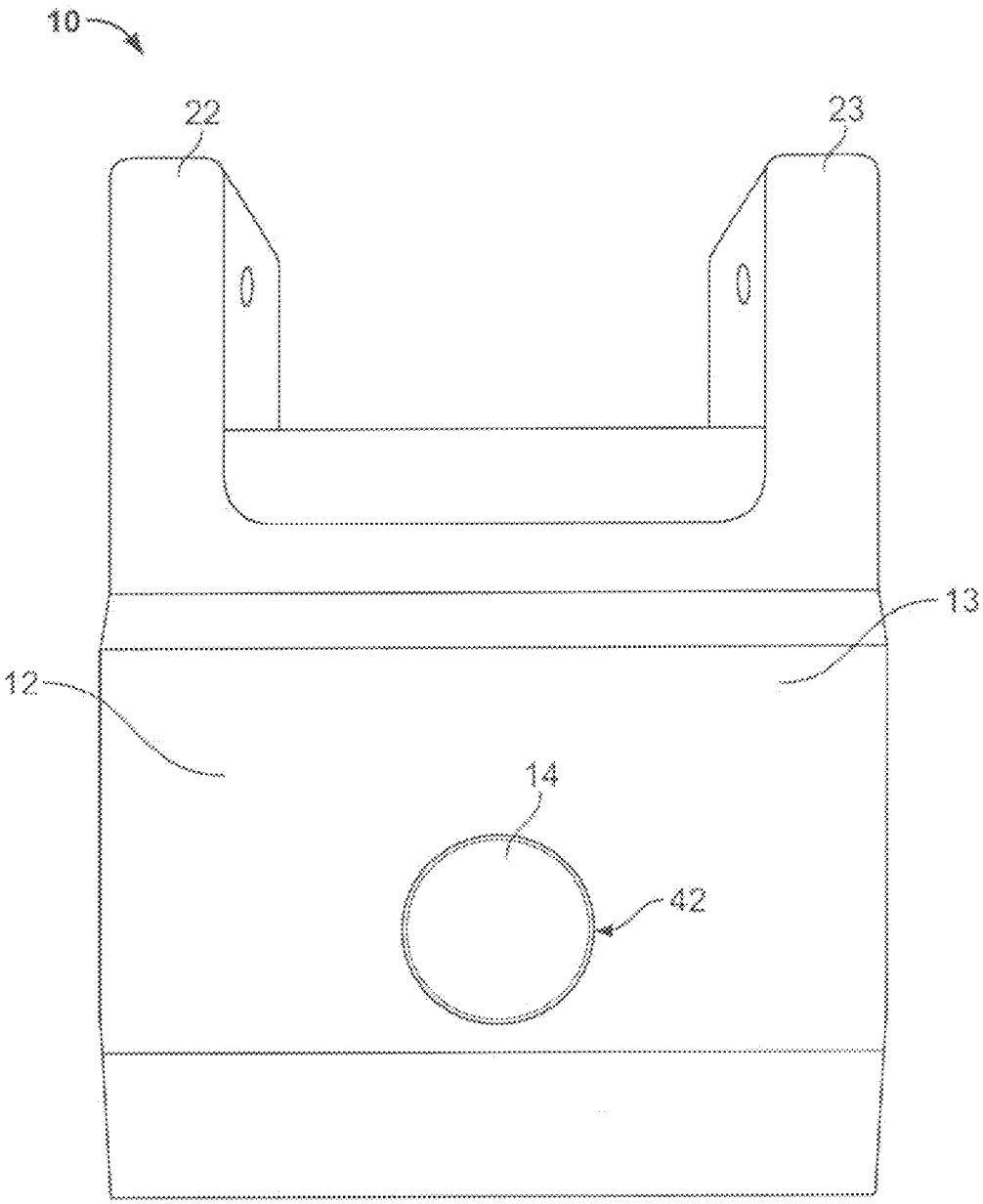
FIG. 4 is a top perspective view of the actuation device of the present invention.
Figure 4A:
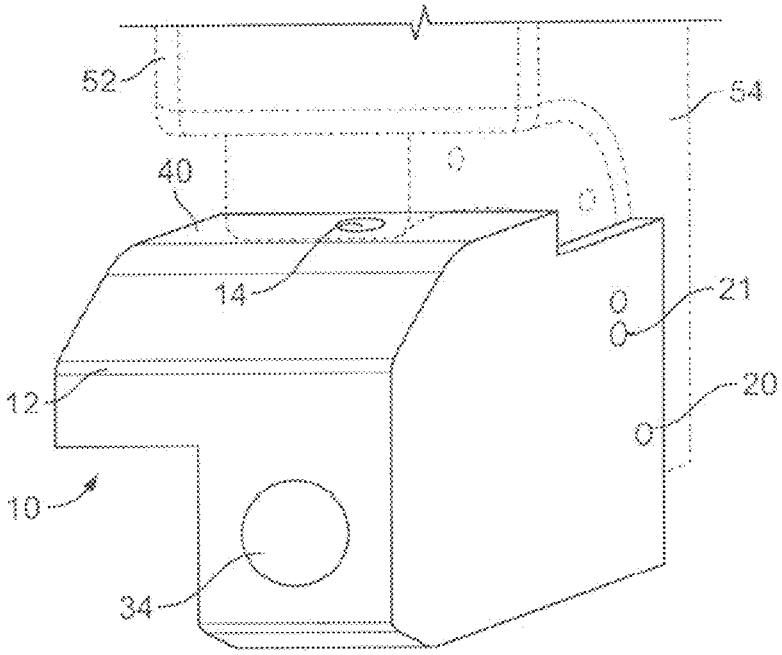
FIGS. 4A and 4B are perspective views of the actuation device of the present invention.
Figure 4B:
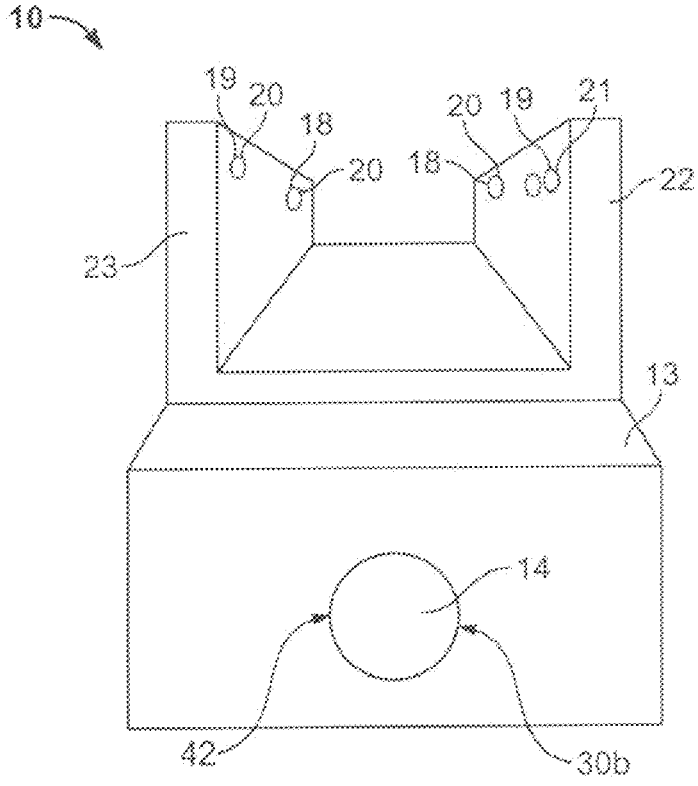
Figure 5:
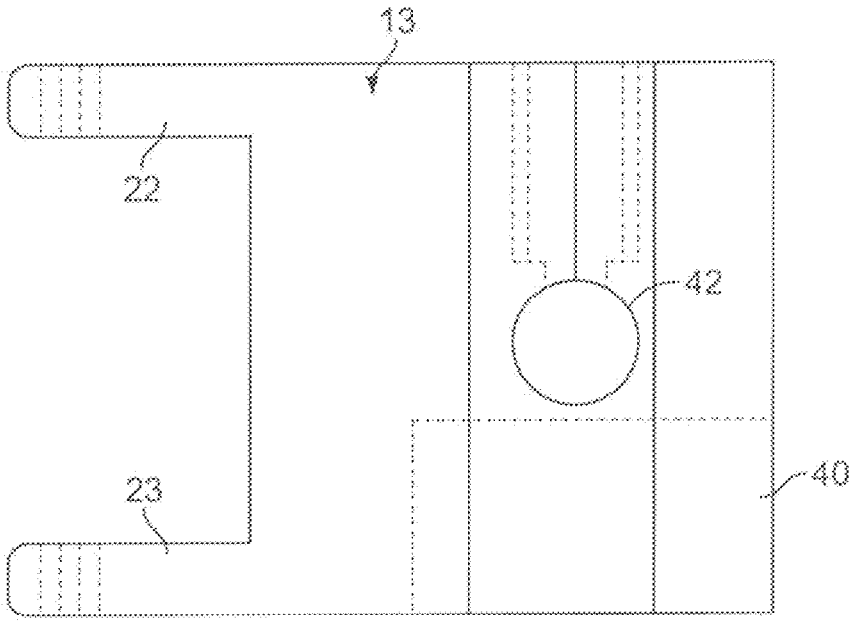
FIG. 5 is a top plan view of the actuation device of the present invention.
Figure 6:
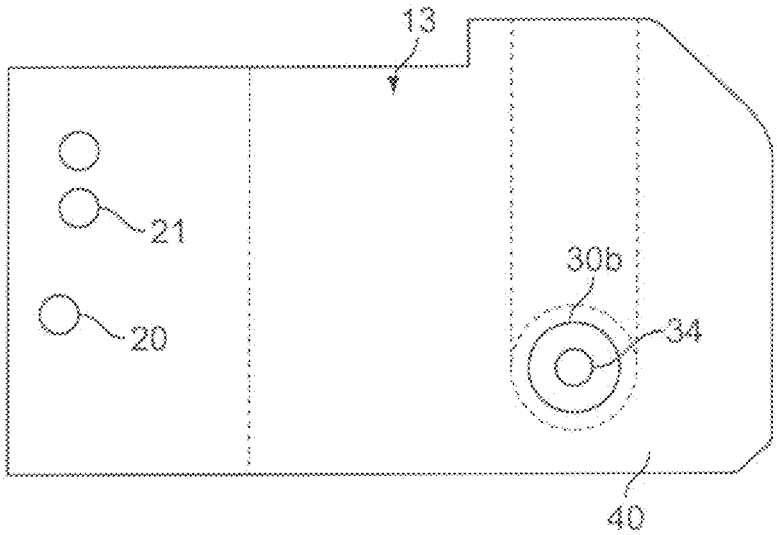
FIG. 6 is a right side plan view of the actuation device of the present invention.
Figure 6A:
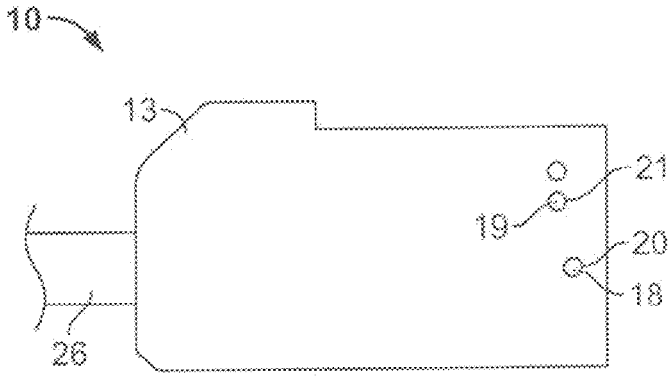
FIGS. 6A and 6B are right and left side views, respectively, of the actuation device of the present invention.
Figure 6B:
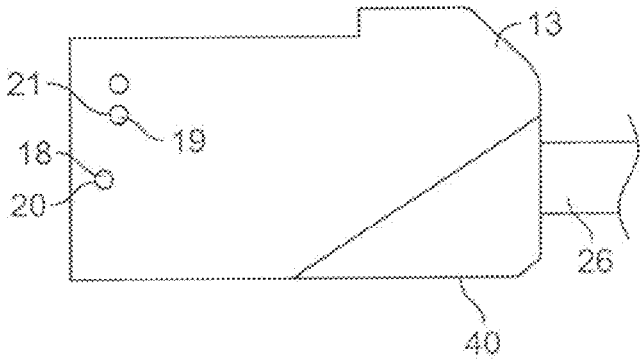
Figure 7:
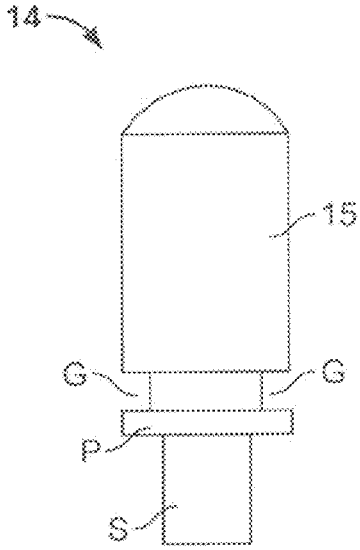
FIG. 7 is a side view of the piston element of the present invention.

Turning now to the figures and in particular FIGS. 1-6, the actuator 10 includes a housing 12 having a piston 14 disposed therein. The actuator housing 12 is a one-piece unit composed of a main body 13 and integral actuator attachment arms 22, 23 as seen in FIGS. 5 and 6. In one embodiment, as shown in FIG. 1, the housing 12 is configured to be used with a pneumatic nailer, such as a nailer available from ITW Industrial Fastening of Elgin, Ill., an Illinois Tool Works company. Preferably, the housing 12 is formed of a strong, durable, lightweight material, such as aluminum.

As the nail count in a magazine in the tool 50 is depleted, a nail follower (nail pusher) N moves toward the front or disbursal section of the nailer 50. Thus, in a preferred embodiment, the main body 13 of the housing 12 has a triangular-shaped clearance cutout 40 formed on an outer surface of the actuator housing 12 to accommodate a follower N on a pneumatic nailer 50.

A drive chamber 42 is formed as a cylindrical bore extending partially through the main body 13 of the actuator housing 12, as shown in FIGS. 4-7. A piston 14 is disposed and slidably movable within the cylindrical drive chamber 42. The piston 14 is made from brass in the present embodiment, but other materials such as steel or plastics or composites thereof are also contemplated. The material of the piston 14 should be capable of withstanding continuous and repetitive strikes/stresses, as well as stresses due to friction.

Actuator attachment arms 22, 23 are integral with the main body 13 of the actuator housing 12. The actuator arms 22, 23 are spaced apart, allowing for the attachment arms 22, 23 to straddle the trigger housing 54 of the tool 50.

The piston 14 comprises a piston head 15, a groove G, a support plate P, and a shaft S. An O-ring 16 is disposed in the groove G of the piston 14. The O-ring 16 acts as a seal or gasket to prevent air from escaping up along the sides of the drive chamber 42, between the piston 14 and the drive chamber 42. It is contemplated that the material used for the O-ring is suitable for extremes in temperature and capable of withstanding repetitive movement and/or vibration, such as a rubber O-ring as is known in the art.

The piston head 15 is configured to extend outwardly from actuator housing 12 through an opening formed by drive chamber 42. In its non-actuated state, the piston head 15 is configured to lie adjacent to or in close proximity of the trigger 52 when the actuator 10 is attached to the pneumatic tool 50.

An air inlet chamber 34 is formed as a cylindrical bore extending partially through the main body 13 of the actuator housing 12, contiguous with and generally normal to drive chamber 42. The air inlet chamber 34 is configured to accept and direct a pressurized gas to the drive chamber 42, as discussed below.

The actuator 10 is attached to the pneumatic tool 50 by pins 18, 19. The pins 18, 19 attach the actuator housing 12 to the trigger housing 54 through pin holes 20, 21 in the actuator housing 12 and through the trigger housing holes 56, 57 on the tool 50. It is anticipated that the pneumatic tool 50 has pre-formed holes in the trigger housing 54 to accept pins 18. However, those skilled in the art will recognized that holes may need to be formed in other pneumatic tools to attach the actuator 10 or that other attachment methods may be required depending on the design of the particular pneumatic tool.

Figure 2:
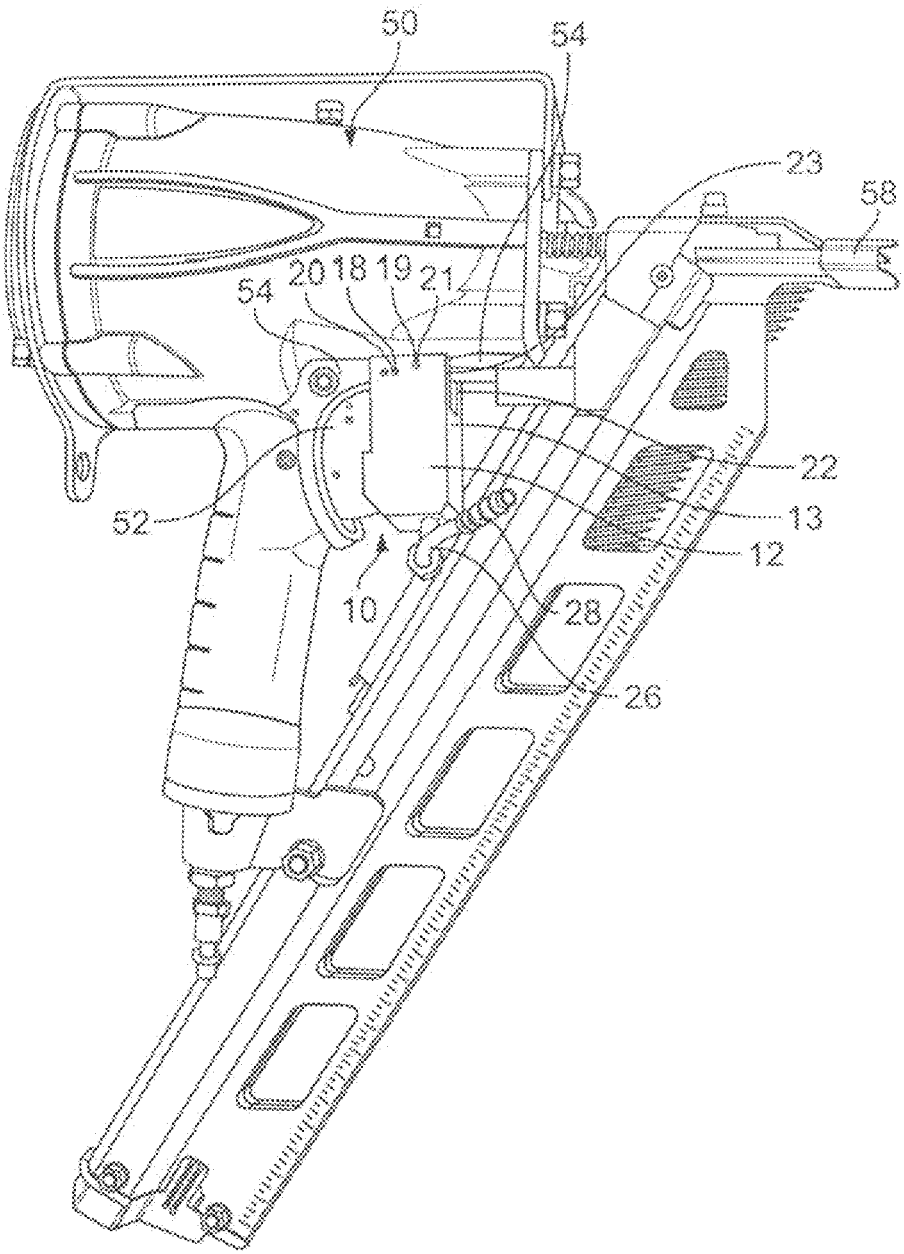
FIG. 2 is a right side view of the actuation device of the present invention attached to a pneumatic tool.

Looking to FIGS. 2 through 4, the actuator 10 is shown with a hose 26 that carries air from a compressor (not shown) to the actuator 10. The hose 26 has two ends, a compressor end 28 that connects the hose 26 to the air compressor, and an actuator end 30, which comprises a brass elbow connector connecting the hose 26 to the actuator 10 at opening **30*b* formed by the air inlet chamber 34 (FIG. 6) on the main body 13 of the actuator housing 12**.

Air from a compressor is pressurized; therefore, when a control valve is opened, or when a signal from a control system activates, air flows from the compressor through the hose 26, through air inlet chamber 34 and into the drive chamber 42 of the actuator 10. The pressurized air in the drive chamber 42 pushes against the support plate P of the piston 14, forcing the piston 14 to move slidably within the drive chamber 42 and toward the trigger 52 of the pneumatic tool 50. The piston 14 then contacts the trigger 52 of the pneumatic tool 50 and depresses the trigger 52, thereby actuating pneumatic tool 50.

After the pneumatic tool 50 is actuated, the air is released from hose 26, and the trigger 52, which is spring-loaded in most pneumatic tools, returns to its original position, forcing the piston 14 to retract and slidably move within the drive chamber 42 toward the housing 12 in preparation for the next actuation. As will be appreciated by those skilled in the art, a shuttle valve may be used in conjunction with the compressor to control the flow of air to and from the actuator 10.

Figure 8A:
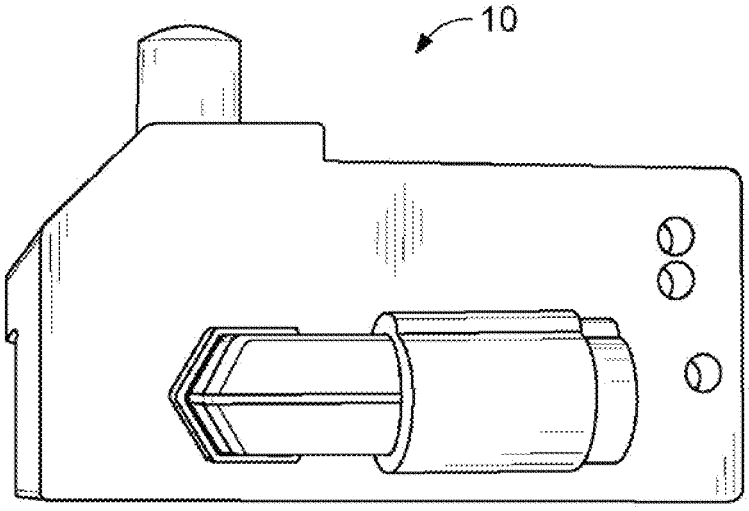
FIG. 8 is a perspective view of first and second embodiments of the activation device in accordance with the present invention.
Figure 8B:
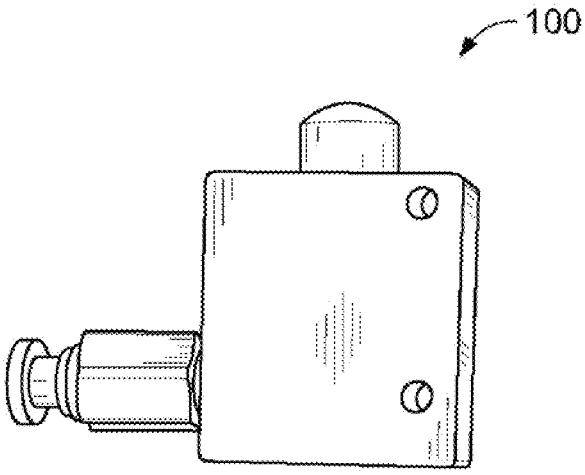

An alternate embodiment of a pneumatic tool actuation device that can be used for smaller pneumatic tools is illustrated in FIGS. 8-15. In FIG. 8, the embodiment 10 described above is shown side-by-side with the alternate embodiment 100.

Figure 9:
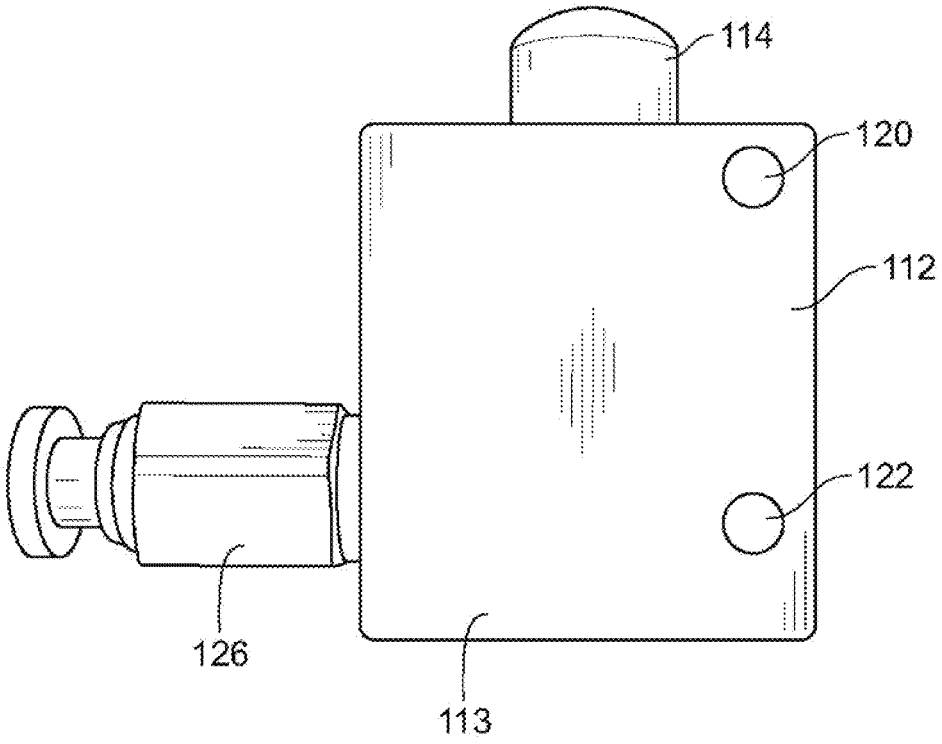
FIG. 9 is a side view of the second embodiment of the activation device illustrated in FIG. 8.
Figure 10:
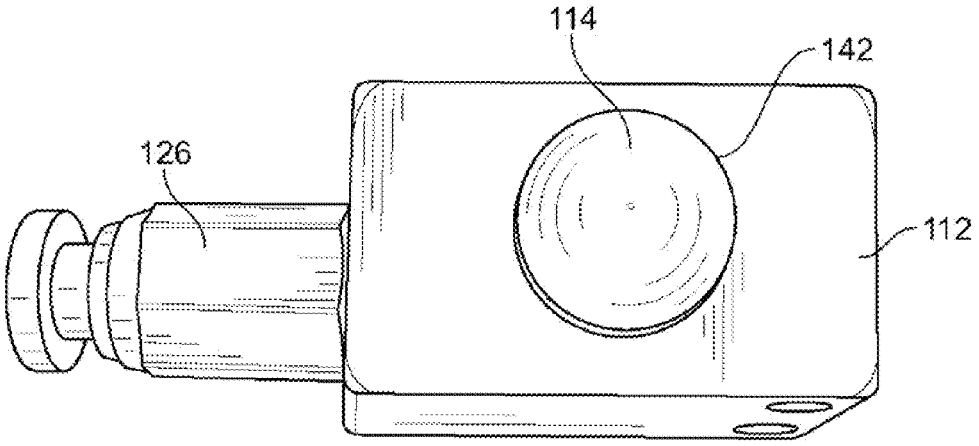
FIG. 10 is a top view of the second embodiment of the activation device illustrated in FIG. 8.

The actuator 100 can be used for smaller devices configured for driving staples, wires, and other like fasteners. The actuator 100 can be used to directly actuate a trigger valve pin. Actuator 100 is comprised of a housing 112 having a piston 114 disposed therein. The actuator housing 112 is a one-piece unit having a main body 113 and integral actuator attachment points 120, 122 as seen in FIG. 9. Preferably, the housing 112 is formed of a strong, durable, lightweight material, such as aluminum.

In this embodiment, the relatively smaller size (as seen in FIG. 8) of the main body 113 precludes the need for a clearance cutout to accommodate a follower (nail pusher) on the pneumatic nailer 150. The follower moves toward the front or disbursal section of the nailer 150 as the nail count in the magazine is depleted and easily bypasses the housing 112 of the pneumatic actuator 100.

Figure 13:
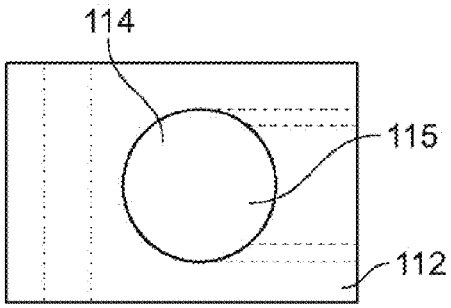
FIGS. 13-15 are various views of the second embodiment of the actuation device showing interior portions in phantom lines.
Figure 14:
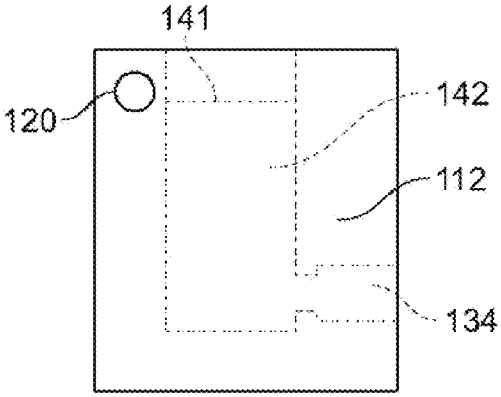
Figure 15:
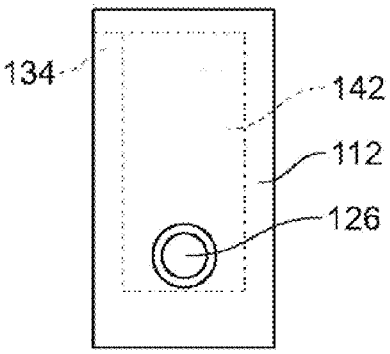

A drive chamber 142 is formed as a cylindrical bore extending partially through the main body 113 of the actuator housing 112, as shown in FIGS. 13-15. A piston 114 is disposed and slidably movable within the cylindrical drive chamber 142. The piston 114 is made from brass in the present embodiment, but other materials such as steel or plastics or composites thereof are also contemplated. The material of the piston 114 should be capable of withstanding continuous and repetitive strikes/stresses as well as stresses due to friction.

Figure 11:
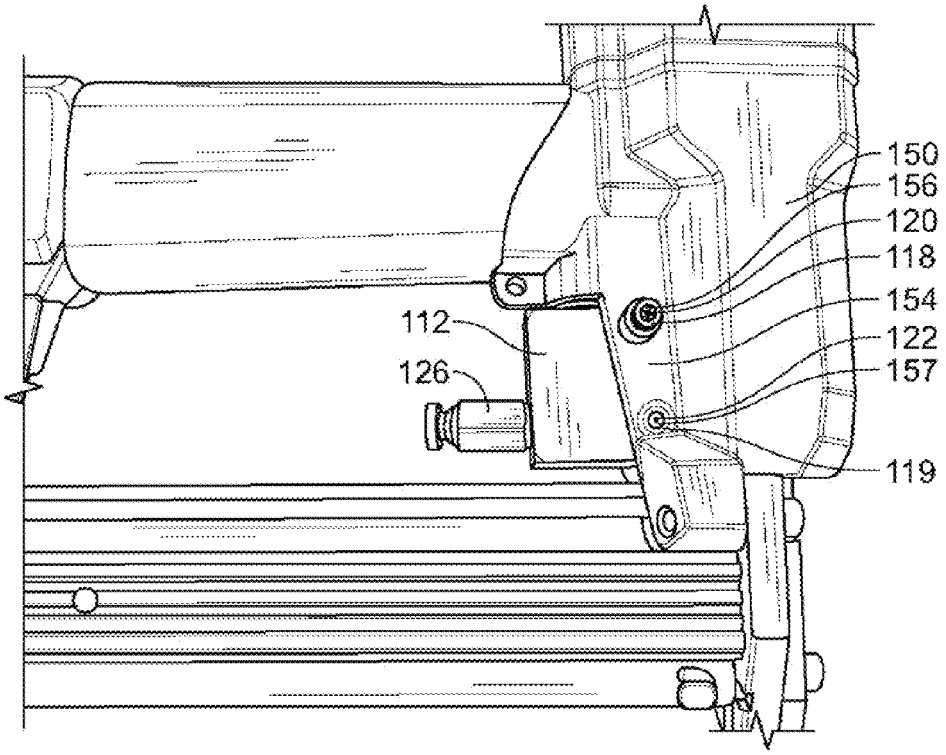
FIG. 11 is a side view of the second embodiment of the activation device illustrated in FIG. 8 mounted to a small tool.
Figure 12:
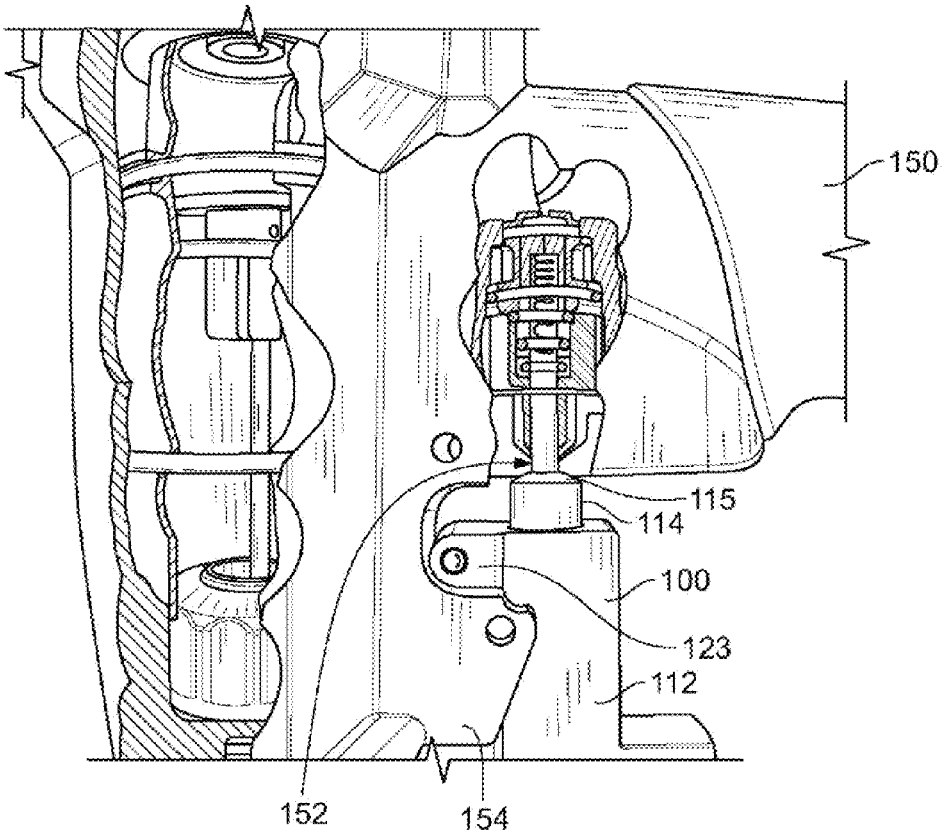
FIG. 12 is a perspective view of the piston element of the second embodiment of the actuation device actuating the trigger valve pin on a pneumatic tool.

Actuator attachment points 120, 122 allow the main body 113 of the actuator housing 112 to be integrated to the pneumatic tool 150. The actuator attachment points 120, 122 in this embodiment are positioned in and secured to the interior of the trigger housing 154 of the pneumatic tool 150, as shown in FIG. 11.

The piston 114 comprises a piston head, a groove, a support plate, and a shaft similar to or the same as previously described. An O-ring 141 is disposed in the groove of the piston 114. The O-ring 141 acts as a seal or gasket to prevent air from escaping up along the sides of the drive chamber 142, between the piston 114 and the drive chamber 142. It is contemplated that the material used for the O-ring 141 is suitable for extremes in temperature and capable of withstanding repetitive movement and/or vibration.

As shown in FIG. 9, the piston head 115 is configured to extend outwardly from the actuator housing 112 through an opening formed by drive chamber 142. In its non-actuated state, the piston head 115 is configured to lie adjacent to or in close proximity of the trigger valve pin 152 when the actuator 110 is attached to the pneumatic tool 150.

As shown in FIGS. 13-15, an air inlet chamber 134 is formed as a cylindrical bore extending partially through the main body 113 of the actuator housing 112, contiguous with and generally normal to the drive chamber 142, and is configured to accept and direct a pressurized gas to the drive chamber 142.

The actuator 100 is attached to the pneumatic tool 150 by pins 118, 119. The pins 118, 119 attach the actuator housing 112 to the trigger housing 154 through fastener receiving openings or pin holes 120, 122 in the actuator housing 112 and through the trigger housing holes 156, 157. It is anticipated that the pneumatic tool 150 has pre-formed holes in the trigger housing 154 to accept pins 118. However, those skilled in the art will recognized that holes may need to be formed in other pneumatic tools to attach the actuator 100 or that other attachment methods may be required depending on the design of the particular pneumatic tool. In this embodiment, the actual trigger of the tool need not be present. The trigger valve pin may be directly actuated by the piston.

When a control valve is opened, or when a signal from a control system activates, air flows from the compressor through a hose and through the air inlet chamber 134 and into the drive chamber 142 of the actuator 100. The pressurized air in the drive chamber 142 pushes against the piston 114, forcing the piston 114 to move slidably within the drive chamber 142 and toward the trigger valve pin 152 of the pneumatic tool 150. The piston 114 then contacts the trigger valve pin 152 of the pneumatic tool 150 and depresses the trigger valve pin 152, thereby actuating pneumatic tool 150.

After the pneumatic tool 150 is actuated, the air is released, and the trigger valve pin 152, which is spring-loaded in most pneumatic tools, returns to its original position, forcing the piston 114 to retract and slidably move within the drive chamber 142 toward the housing 112 in preparation for the next actuation. As will be appreciated by those skilled in the art, a shuttle valve may be used in conjunction with the compressor to control the flow of air to and from the actuator 100.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A pneumatic tool actuation device for use in an associated pneumatic tool having a naked trigger valve pin comprising:

a housing having a piston drive chamber and an air inlet chamber formed therein, the housing having a fastener receiving opening, wherein the fastener receiving opening is configured to attach the actuation device to the pneumatic tool;

a piston disposed within the piston drive chamber and configured to slidably move within the piston drive chamber, the piston having a piston head and a support plate, a shaft and an annular groove formed between the piston head and the support plate, the piston actuatable between a first condition where the piston is urged toward an open end of the drive chamber and a second condition where the piston is not urged toward the open end of the drive chamber; and an O-ring, wherein the O-ring is disposed in the annular groove and wherein the O-ring forms a seal between the piston and the piston drive chamber, and wherein movement of the piston actuates the trigger valve pin directly, without contact with a trigger of the pneumatic tool, wherein the piston drive chamber and the air inlet chamber are contiguous.

2. The pneumatic tool actuation device of claim 1 wherein a longitudinal axis of the piston drive chamber is generally normal to a longitudinal axis of the air inlet chamber.

3. The pneumatic tool actuation device of claim 1 wherein the piston drive chamber is cylindrical.

4. The pneumatic tool actuation device of claim 1 wherein the air inlet chamber is cylindrical.

5. The pneumatic tool actuation device of claim 1 wherein at least one fastener receiving opening is configured to attach the actuation device to the pneumatic tool using at least one pin.

6. The pneumatic tool actuation device of claim 1 further comprising a connector for operably engaging a gas supply, the connector disposed at an entrance of the air inlet chamber.

7. The pneumatic tool actuation device of claim 6 wherein the connector comprises an elbow connector.

8. The pneumatic tool actuation device of claim 7 wherein a gas from the gas supply enters the piston drive chamber through the air inlet chamber and moves the piston.

9. The pneumatic tool actuation device of claim 1, wherein the housing is positionable on an interior surface of a pneumatic tool actuation device trigger housing.

10. The pneumatic tool actuation device of claim 1 wherein the housing is formed of aluminum.

11. The pneumatic tool actuation device of claim 1 wherein the piston is formed of brass.

12. An automatically actuatable pneumatic tool comprising:

a pneumatic tool having a trigger housing and a naked trigger valve pin, the pneumatic tool having no trigger, and the trigger housing having a trigger housing hole;

a pneumatic tool actuation device mounted to the tool, the actuation device having an actuation device housing, the actuation device housing having a piston drive chamber and an air inlet chamber therein, the piston drive chamber and air inlet chamber bring contiguous with one another, and the actuation device housing at least one faster receiving opening, wherein the fastener receiving opening is aligned with the trigger housing hole such that the fastener receiving opening and the trigger housing hole are configured to receive a fastener to attach the actuation device to the pneumatic tool on an interior surface of the pneumatic tool housing; and piston disposed within the piston drive chamber and configured to slidably move within the piston drive chamber, the piston having a piston head and a support plate, a shaft and an annular groove formed between the piston head and the support plate, and an O-ring, wherein the O-ring is disposed in the annular groove and wherein the O-ring forms a seal between the piston and the piston drive chamber, wherein movement of the piston actuates the trigger valve pin directly.

13. The automatically actuatable pneumatic tool of claim 12 wherein the at least one fastener receiving opening is configured to attach the actuation device to the tool using at least one pin that is disposed through the at least one fastener receiving opening and at least one trigger housing hole.

14. The automatically actuatable pneumatic tool of claim 12 wherein the tool further comprises a nail follower that bypasses the actuation device as the follower moves towards a disbursal section of the tool.

15. A system for actuating a trigger valve pin of a tool comprising:

a tool actuation device for use with a tool having a trigger valve pin and no trigger, wherein the actuation device includes a housing having a piston drive chamber and an air inlet chamber formed therein, the piston drive chamber and air inlet chamber being contiguous with one another, the housing further including a fastener receiving opening, wherein the fastener receiving opening is configured to receive a fastener to attach the actuation device to the tool; and a piston disposed within the piston drive chamber and configured to slidably move within the piston drive chamber, the piston actuatable between a first condition where the piston is urged toward an open end of the drive chamber and a second condition where the piston is not urged toward the open end of the drive chamber, and wherein movement of the piston actuates the trigger valve pin directly, without contact with a trigger, wherein the tool actuation device is attached to the tool such that movement of the piston causes the piston to directly contact and actuate, the trigger valve pin.

16. The system of claim 15 wherein the tool actuation device is attached to an interior of a trigger housing of the tool.

17. The system of claim 15 wherein the actuation device is attached to the tool using a pin that is disposed through the fastener receiving opening and a trigger housing hole.

* * * * *

UNITED STATES PATENT AND TRADEMARK OFFICE

CERTIFICATE OF CORRECTION

PATENT NO. : 8,881,963 B2
APPLICATION NO. : 12/265944
DATED : November 11, 2014
INVENTOR(S) : Genaro O. Cortez It is certified that error appears in the above-identified patent and that said Letters Patent is hereby corrected as shown below:

In the claims,

Column 6, line 40, Claim 12, “therein,” to read as --formed therein,--.

Column 6, line 41 approx., Claim 12, “bring” to read as --being--.

Column 6, line 42 approx., Claim 12, “at least” to read as --having at least--.

Column 6, line 43 approx., Claim 12, “faster” to read as --fastener--.

Column 6, line 48 approx., Claim 12, “tool” to read as --tool trigger--.

Column 6, line 49 approx., Claim 12, “piston” (first occurrence) to read as --a piston--.

Column 7, line 22 approx., Claim 15, “actuate,” to read as --actuate--.

Signed and Sealed this
Fourteenth Day of April, 2015

Michelle K. Lee

Michelle K. Lee
*Director of the United States Patent and Trademark Office*